US012352475B2

(12) United States Patent
Creswell

(10) Patent No.: US 12,352,475 B2
(45) Date of Patent: Jul. 8, 2025

(54) AIR CONDITIONING SYSTEM

(71) Applicant: Terrence Creswell, St. Louis, MO (US)

(72) Inventor: Terrence Creswell, St. Louis, MO (US)

( * ) Notice: Subject to any disclaimer, the term of this patent is extended or adjusted under 35 U.S.C. 154(b) by 193 days.

(21) Appl. No.: 18/122,813

(22) Filed: Mar. 17, 2023

(65) Prior Publication Data

US 2024/0003601 A1 Jan. 4, 2024

Related U.S. Application Data

(60) Provisional application No. 63/357,845, filed on Jul. 1, 2022.

(51) Int. Cl.
*F25B 39/04* (2006.01)

(52) U.S. Cl.
CPC ..... *F25B 39/04* (2013.01); *F25B 2339/047* (2013.01)

(58) Field of Classification Search
CPC ..... F24F 1/039; F25B 39/04; F25B 2339/047
See application file for complete search history.

(56) References Cited

U.S. PATENT DOCUMENTS

| | | | | |
|---|---|---|---|---|
| 4,494,596 | A * | 1/1985 | Bradshaw | F24F 3/14 261/153 |
| 8,671,713 | B2 | 3/2014 | Cho | |
| 10,551,103 | B2 | 2/2020 | Cheong et al. | |
| 2005/0086963 | A1 | 4/2005 | Lee | |
| 2008/0083231 | A1 | 4/2008 | Wang | |
| 2010/0218527 | A1 | 9/2010 | Kitagishi et al. | |
| 2011/0100043 | A1 | 5/2011 | Matubara et al. | |
| 2011/0113802 | A1 | 5/2011 | Wakamoto et al. | |
| 2012/0125027 | A1 | 5/2012 | Echols | |
| 2012/0174614 | A1* | 7/2012 | Cho | F25B 31/004 62/468 |
| 2013/0091877 | A1 | 4/2013 | Cho et al. | |
| 2013/0091882 | A1 | 4/2013 | Cho et al. | |
| 2015/0267929 | A1 | 9/2015 | Kim et al. | |
| 2018/0128497 | A1 | 5/2018 | Blumenfeld | |
| 2018/0334014 | A1 | 11/2018 | Nakasako et al. | |
| 2019/0316817 | A1* | 10/2019 | Donovan | F25B 23/00 |
| 2021/0008488 | A1 | 1/2021 | Schubring et al. | |
| 2022/0042709 | A1 | 2/2022 | Kataoka | |

FOREIGN PATENT DOCUMENTS

| | | | |
|---|---|---|---|
| CN | 206905152 | | 1/2018 |
| CN | 206905152 U | * | 1/2018 |
| CN | 208664897 | | 3/2019 |
| JP | 2014-224646 | | 12/2014 |
| WO | WO2018/088025 | | 5/2018 |

OTHER PUBLICATIONS

Pdf is translation of foreign reference CN 206905152 U (Year: 2018).*

* cited by examiner

*Primary Examiner* — Len Tran
*Assistant Examiner* — Kamran Tavakoldavani
(74) *Attorney, Agent, or Firm* — David H. Chervitz

(57) ABSTRACT

An air conditioning system has an evaporator unit capable of producing condensation, a condenser unit having a first water circuit connected to an inlet, the first water circuit having a first water circuit solenoid valve and a spray nozzle positioned along a first water circuit rail, and an outlet, and a reservoir for collecting condensation from the evaporator unit and for providing water to the condenser unit through the inlet.

5 Claims, 9 Drawing Sheets

AIR CONDITIONING SYSTEM

RELATED APPLICATION

This application claims priority to U.S. Provisional Patent Application No. 63/357,845, which was filed on Jul. 1, 2022, the disclosure of which is incorporated herein by reference.

BACKGROUND

This disclosure relates generally to an air conditioning system, and more particularly to an air conditioning system that has an improved condensing unit.

Air conditioning systems are used to cool an enclosed space, such as a house, by circulating a refrigerant within piping through various cooling cycles. The cooling cycles include compression, condensation, expansion, and evaporation. To accomplish this a compressor, an expansion valve, a condenser, and an evaporator are provided as part of the air conditioning system. The air conditioning system has a refrigerant in a liquid state, at a high pressure and a high temperature, that is provided to an expansion device or valve from a condensing coil. The expansion device lowers the temperature and pressure of the refrigerant and provides the refrigerant to an evaporator coil which is positioned within a plenum. A blower motor blows air passed the evaporator coil to produce cooled air which is circulated throughout the house via the plenum or duct work. The cold refrigerant is then provided from the evaporator coil to a compressor via a suction line. The refrigerant provided from the evaporator coil is a gas at a low temperature and a low pressure. The compressor is positioned outside of the house. The compressor provides the refrigerant as a gas at a high temperature and a high pressure to the condensing coil. The condensing coil changes the refrigerant back to the liquid at a high temperature and a high pressure which is again provided to the expansion device to repeat the cycle. The condensing coil is also provided outside the house with the compressor. The compressor and the condensing coil may include other parts such as a housing, a capacitor, a fan, and fins that are also outside of the house exposed to the elements.

One disadvantage with the air conditioning system is that the compressor and the condensing coil are located outside the house. These parts are subject to being in the elements where changes in temperature, weather, and seasons has a tendency to reduce the lifetime of these parts. Since these parts are subject to failure these parts will have to be replaced over time. Further, such parts need to be periodically maintained. For example, the fins of the condensing coil need to be cleaned or straighten to insure that the efficiency of the system is maintained. Also, these various components may be positioned or secured within a painted housing that is intended to protect the various components. Over time the paint may begin to peel or the housing may rust due to the protective paint coating peeling, both of which are unsightly and may lead to the failure of the housing.

The present disclosure is designed to obviate and overcome many of the disadvantages and shortcomings experienced with prior air conditioning systems. Particularly, it would be advantageous to be able to have an air conditioning system in which the system is fully enclosed and away from outside elements. Moreover, the present disclosure is related to an air conditioning system that utilizes fewer components that can fail or need to be replaced. Also, the present disclosure of an air conditioning system has an improved condenser unit that requires fewer components that can fail.

SUMMARY

In one form of the present disclosure, an air conditioning system comprises an evaporator unit capable of producing condensation, a condenser unit having a first water circuit connected to an inlet, the first water circuit having a first water circuit solenoid valve and a spray nozzle positioned along a first water circuit rail, and an outlet, and a reservoir for collecting condensation from the evaporator unit and for providing water to the condenser unit through the inlet.

In another form of the present disclosure, an air conditioning system comprises an evaporator unit capable of producing condensation, a condenser unit having a plurality of water circuits with one of the water circuits being connected to an inlet, each of the water circuits having a water circuit solenoid valve and a first spray nozzle positioned along a water circuit rail, and an outlet, and a reservoir for collecting condensation from the evaporator unit and for providing water to the condenser unit through the inlet.

In still another form of the present disclosure, an air conditioning system comprises an evaporator unit capable of producing condensation, a condenser unit having a first water circuit connected to an inlet, the first water circuit having a first water circuit solenoid valve and a first spray nozzle positioned along a first water circuit rail, a second water circuit having a second water circuit solenoid valve and a second spray nozzle positioned along a second water circuit rail, a third water circuit having a third water solenoid valve and a third spray nozzle positioned along a third water circuit rail, a fourth water circuit having a fourth water circuit solenoid valve and a fourth spray nozzle positioned along a fourth water circuit rail, a fifth water circuit having a fifth water circuit solenoid valve and a fifth spray nozzle positioned along a fifth water circuit rail, a sixth water circuit having a sixth water circuit solenoid valve and a sixth spray nozzle positioned along a sixth water circuit rail, and an outlet, and a reservoir for collecting condensation from the evaporator unit and for providing water to the condenser unit through the inlet.

The present disclosure provides an air conditioning system in which all of the components of the system are enclosed and away from any environmental elements.

The present disclosure provides an air conditioning system that may be used to retrofit existing air conditioning systems.

The present disclosure provides an air conditioning system that provides an improved condenser unit.

The present disclosure also provides an air conditioning system that can be used to cool the interior of any sized structure.

The present disclosure is related to an air conditioning system that prevents vandalism or theft by having the air conditioning system within a structure.

The present disclosure is also related to an air conditioning system that is capable of increasing the life expectancy of the air conditioning system by having all of the components of the air conditioning system within a structure.

The present disclosure provides an air conditioning system that reduces energy costs by having all of the components of the air conditioning system within a structure and not exposed to an outside environment.

The present disclosure also provides an air conditioning system that reduces the need for service and repairs by having all of the components of the air conditioning system within a structure.

The present disclosure is related to an air conditioning system that reduces refrigerant leaks by having all of the components of the air conditioning system within a structure.

The present disclosure is also related to an air conditioning system that reduces compressor failure by having all of the components of the air conditioning system within a structure.

The present disclosure provides an air conditioning system that reduces the need for annual preventative maintenance due to all of the components of the air conditioning system being within a structure.

The present disclosure also provides an air conditioning system that has a display for alerting an individual to any operational problems of the air conditioning system for troubleshooting purposes.

The present disclosure provides an air conditioning system that requires fewer components that can fail or need to be replaced.

The present disclosure provides an air conditioning system that can be constructed using readily available materials and construction techniques and machinery.

These and other advantages of the present disclosure will become apparent after considering the following detailed specification in conjunction with the accompanying drawings, wherein:

DETAILED DESCRIPTION OF A PREFERRED EMBODIMENT

Figure 1:
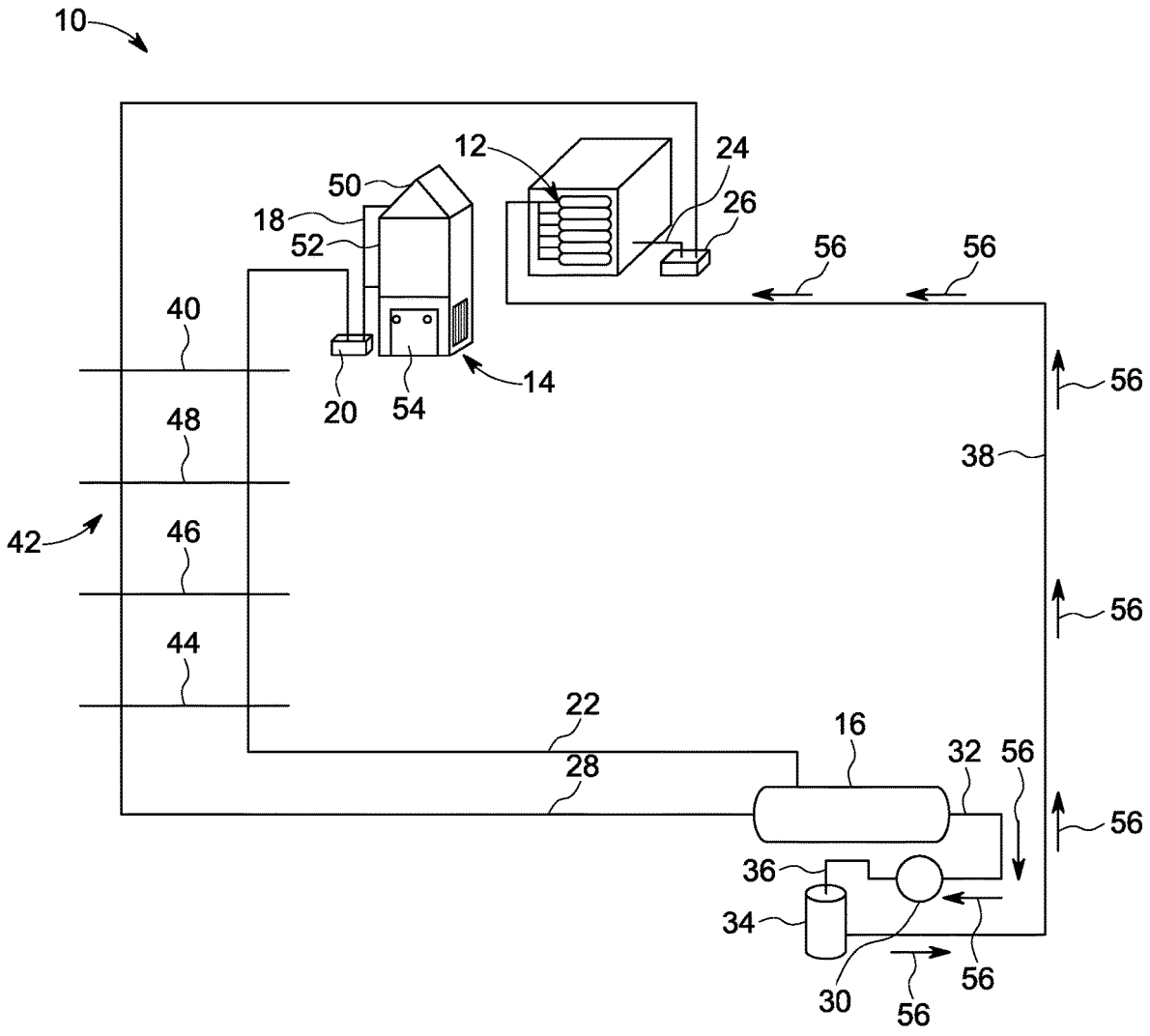
FIG. 1 is a schematic block diagram of an air conditioning system constructed according to the present disclosure.

Referring now to the drawings, wherein like numbers refer to like items, number 10 identifies a preferred embodiment of an air conditioning system constructed according to the present disclosure. Referring now to FIG. 1, the air conditioning system 10 is shown to comprise a condenser unit 12 and an evaporator unit 14 coupled to a cooling tank 16. In the evaporator unit 14 condensate or water is collected from within the evaporator unit 14 and is provided via a conduit or pipe 18 to an evaporator pump 20. An evaporator drain line or pipe 22 is connected to the pump 20 to the cooling tank 16. In this manner, water from the evaporator unit 14 is provided to the cooling tank 16. In the condenser unit 12 water collected from the unit 12 is provided by a conduit or pipe 24 to a condenser pump 26. The manner in which water is available from within the condenser unit 12 will be discussed in detail further herein. A condenser drain line or pipe 28 is connected to the pump 26 and the cooling tank 16. Water from the condenser unit 12 is provided to the cooling tank 16 via the drain line 28. The cooling tank 16 may be initially primed with a supply of water or may be connected to a main water supply (not shown). Water from the cooling tank 16 is provided to a cooling tank pump 30 by use of a conduit or pipe 32. The cooling tank pump 30 is connected to a water softener unit 34 by a conduit or pipe 36. Once water is conditioned by the water softener unit 34, such water is provided to the condenser unit 12 by a conduit or pipe 38. As by way of example only and not in a limiting sense, the condenser unit 12 and the evaporator unit 14 may be located in an attic 40 of a house 42 and the cooling tank 16 and the water softener unit 34 may be positioned in a basement 44 of the house 42. The house 42 may also have a first floor 46 and a second floor 48 which the air conditioning system 10 is employed to cool the house 42.

Although not shown in detail, the evaporator unit 14 may include an expansion device or valve that receives a refrigerant in liquid form from the condenser unit 12. The expansion device lowers the temperature and pressure of the refrigerant and provides the refrigerant to an evaporator coil 50 which is positioned within a plenum 52. A blower motor 54 blows air passed the evaporator coil 50 to produce cooled air which is circulated throughout the house 42 via the plenum 52 or other air handling duct work. The cold refrigerant is then provided from the evaporator coil 50 to the condenser unit 12 via a line. As can be appreciated, water from the cooling tank 16 is provided to the condenser unit 12, as depicted by arrows 56, with the water being used to transfer heat from the refrigerant received from the evaporator unit 14. In view of this, there is no need to have the condenser unit 12 outside of the house 42. As has been described, this reduces the wear and tear on the unit 12 and fewer repairs are required or needed.

Figure 2:
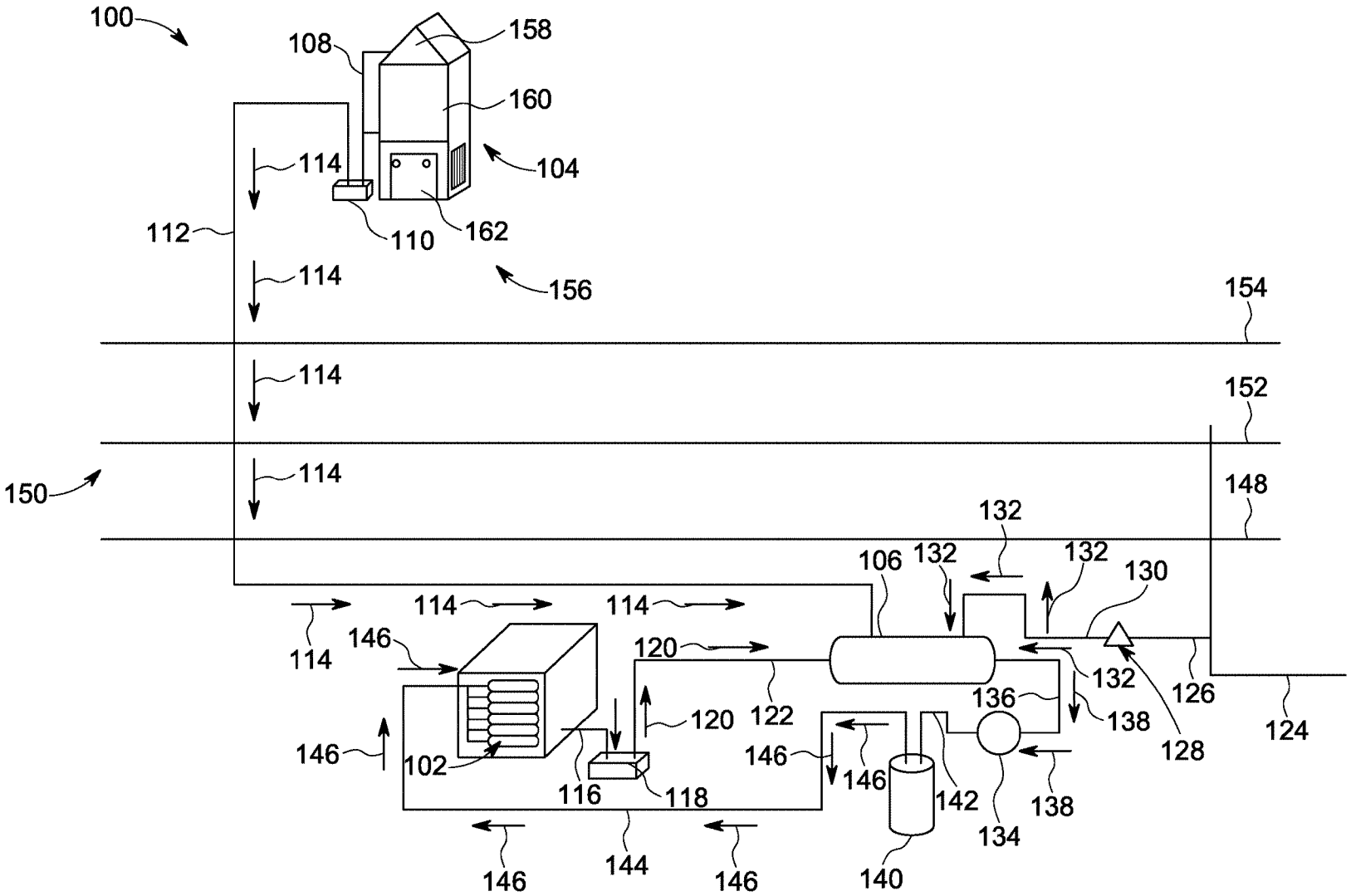
FIG. 2 is a schematic block diagram of another embodiment of an air conditioning system constructed according to the present disclosure.

Withe reference now to FIG. 2, another embodiment of an air conditioning system 100 is shown constructed according to the present disclosure. The air conditioning system 100 comprises a condenser unit 102 and an evaporator unit 104 coupled to a cooling tank 106. In the evaporator unit 104 condensate or water is collected from within the evaporator unit 104 and is provided via a conduit or pipe 108 to an evaporator pump 110. An evaporator drain line or pipe 112 is connected to the pump 110 and to the cooling tank 106. Arrows 114 show the direction of flow of water from the evaporator unit 104 to the cooling tank 106. In the condenser unit 102 water collected from the unit 102 is provided by a conduit or pipe 116 to a condenser pump 118. Arrows 120 show the direction of flow of water from the condenser unit 102 and the pump 118 to the cooling tank 106. The manner in which water is available from within the condenser unit 102 will be discussed in detail further herein. A condenser drain line or pipe 122 is connected to the pump 118 and the cooling tank 106. The cooling tank 106 may be supplied with water from a main water supply 124. A branch 126 of the main water supply 124 is provided to a solenoid controlled water inlet valve 128. A pipe 130 provides water from the valve 128 to the cooling tank 106. Arrows 132 show the flow of water from the valve 128 to the cooling tank 106. Water from the cooling tank 106 is provided to a cooling tank pump 134 by use of a conduit or pipe 136. Arrows 138 indicate the direction of water flow from the cooling tank 106 to the pump 134. The cooling tank pump 134 is connected to a water softener unit 140 by a conduit or pipe 142. Once water is conditioned by the water softener unit 140, such conditioned water is provided to the condenser unit 102 by a conduit or pipe 144. Arrows 146 depict the direction of water flow from the water softener unit 140 to the condenser unit 102. The condenser unit 102, the cooling tank 106, and the water softener unit 140 may be located in a basement 148 of a house 150. The house 150 may have a first floor 152, a second floor 154, and an attic 156. The evaporator unit 104 may be located in the attic 156.

The evaporator unit 104 may include an expansion device or valve (not shown) that receives a refrigerant in liquid form from the condenser unit 102. The expansion device lowers the temperature and pressure of the refrigerant and provides the refrigerant to an evaporator coil 158 which is positioned within a plenum 160. A blower motor 162 blows air passed the evaporator coil 158 to produce cooled air which is circulated throughout the house 150 via the plenum 160 or other air handling duct work. The cold refrigerant is then provided from the evaporator coil 158 to the condenser unit 102 via a line. As can be appreciated, water from the cooling tank 106 is provided to the condenser unit 102, as depicted by arrows 138 and 146, with the water being used to transfer heat from the refrigerant received from the evaporator unit 104. In view of this, there is no need to have the condenser unit 102 outside of the house 150.

Figure 3:
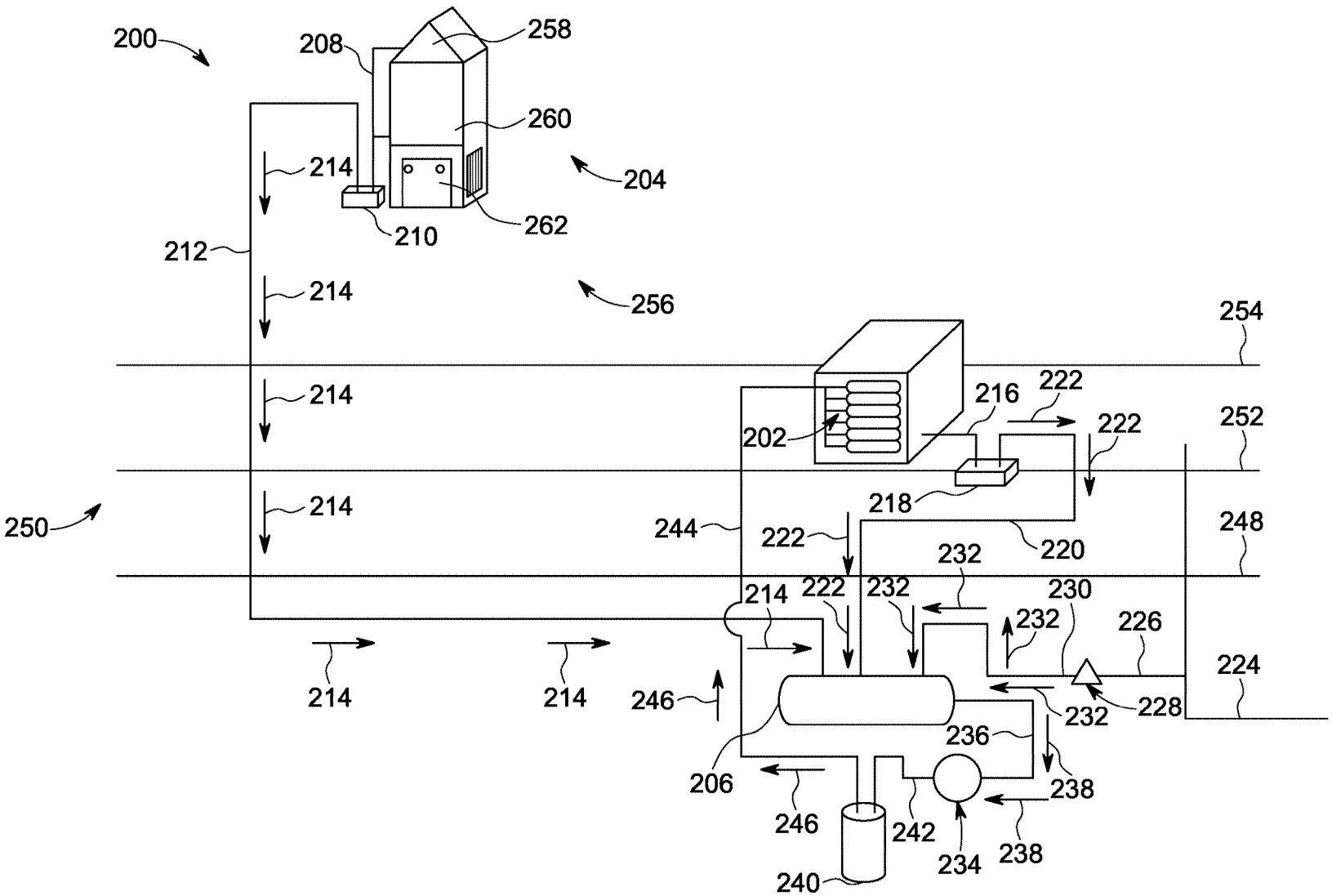
FIG. 3 is a schematic block diagram of another embodiment of an air conditioning system constructed according to the present disclosure.

FIG. 3 illustrates another embodiment of an air conditioning system 200 constructed according to the present disclosure. The air conditioning system 200 comprises a condenser unit 202 and an evaporator unit 204 coupled to a cooling tank 206. In the evaporator unit 204 condensate or water is collected from within the evaporator unit 204 and is provided via a conduit or pipe 208 to an evaporator pump 210. An evaporator drain line or pipe 212 is connected to the pump 210 and to the cooling tank 206. Arrows 214 show the direction of flow of water from the evaporator unit 204 to the cooling tank 206. In the condenser unit 202 water collected from the unit 202 is provided by a conduit or pipe 216 to a condenser pump 218. A condenser drain line or pipe 220 is connected to the pump 218 and the cooling tank 206. Arrows 222 show the direction of flow of water from the condenser unit 202 and the pump 218 to the cooling tank 206. The manner in which water is available from within the condenser unit 202 will be discussed in detail further herein. The cooling tank 206 may be supplied with water from a main water supply 224. A branch 226 of the main water supply 224 is provided to a solenoid controlled water inlet valve 228. A pipe 230 provides water from the valve 228 to the cooling tank 206. Arrows 232 show the flow of water from the valve 228 to the cooling tank 206. Water from the cooling tank 206 is provided to a cooling tank pump 234 by use of a conduit or pipe 236. Arrows 238 indicate the direction of water flow from the cooling tank 206 to the pump 234. The cooling tank pump 234 is connected to a water softener unit 240 by a conduit or pipe 242. Once water is conditioned by the water softener unit 240, such conditioned water is provided to the condenser unit 202 by a conduit or pipe 244. Arrows 246 depict the direction of water flow from the water softener unit 240 to the condenser unit 202. The cooling tank 206 and the water softener unit 240 may be located in a basement 248 of a house 250. The house 250 may have a first floor 252, a second floor 254, and an attic 256. The condenser unit 202 may be located in the second floor 252. The evaporator unit 204 may be located in the attic 256. Again, in this manner, the air conditioning system 200 is located within the house 250 and not exposed to the outside elements.

The evaporator unit 204 may include an expansion device or valve (not shown) that receives a refrigerant in liquid form from the condenser unit 202. The expansion device lowers the temperature and pressure of the refrigerant and provides the refrigerant to an evaporator coil 258 which is positioned within a plenum 260. A blower motor 262 blows air passed the evaporator coil 258 to produce cooled air which is circulated throughout the house 250 via the plenum 260 or other air handling duct work. The cold refrigerant is then provided from the evaporator coil 258 to the condenser unit 202 via a line. As can be appreciated, water from the cooling tank 206 is provided to the condenser unit 202, as depicted by arrows 238 and 246, with the water being used to transfer heat from the refrigerant received from the evaporator unit 204. With this particular arrangement, there is no need to have the condenser unit 202 outside of the house 250.

Although various locations of the condenser units 12, 102, and 202 and the evaporator units 14, 104, and 204 have been shown in various locations within the houses 50, 150, and 250, it is also possible to place the systems 10, 100, and 200 in the same location. In particular, the systems 10, 100, and 200 may be positioned in each respective basement 44, 148, and 248. However, it should be appreciated that the condenser units 12, 102, and 202 are located within the houses 50, 150, and 250 and are not outside.

Figure 4:
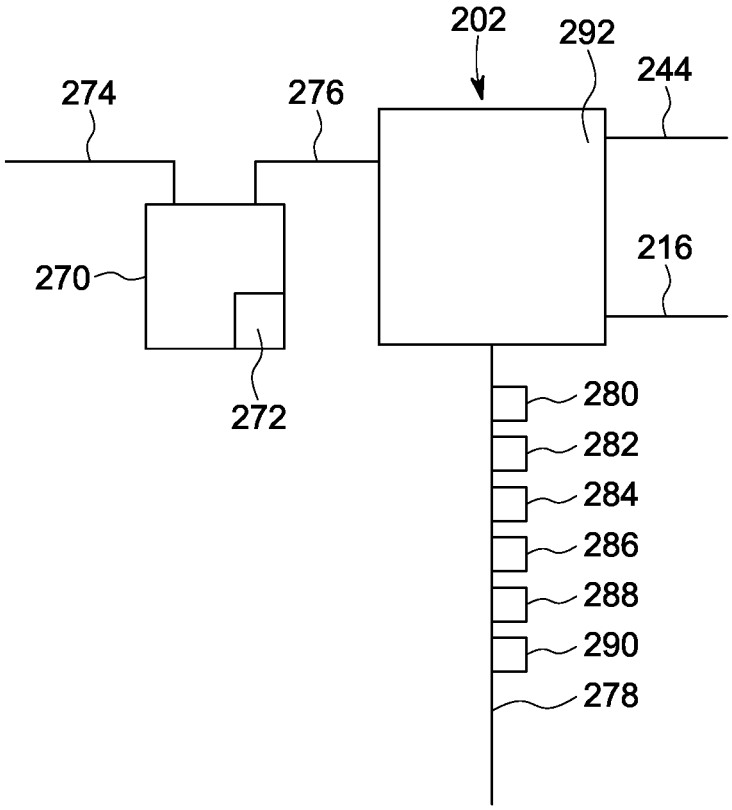
FIG. 4 is a schematic block diagram of a condenser unit of the air conditioning system of the present disclosure.

FIG. 4 illustrates the condenser unit 202 and the various connections to the evaporator unit 204 shown in FIG. 3. The condenser unit 202 has the pipe 244 for receiving water provided from the cooling tank 206 (FIG. 3). The pipe 244 serves as an inlet to receive water. The manner in which the water is used within the condenser unit 202 will be explained in more detail herein. The condenser unit 202 has the pipe 216 that provides water from the condenser unit 202 to the pump 218 (FIG. 3). The pipe 216 serves as an outlet to empty water from the unit 202. A compressor 270 has a run capacitor 272. The compressor 270 is connected to the evaporator unit 204 (FIG. 3) by a suction line 274. The suction line 274 is capable of receiving a refrigerant (not shown) in a gas form from the evaporator unit 204. The refrigerant is at a low temperature and a low pressure. The compressor 270 provides the refrigerant to the condenser unit 202 through a line 276. The refrigerant is still in a gas form but it is at a high temperature and a high pressure. The condenser unit 202 condenses the gas refrigerant into a liquid refrigerant and sends the liquid refrigerant back to the evaporator unit 204 via a line 278. The liquid refrigerant in the line 278 is at a high temperature and a high pressure. The line 278 has a first pressure switch 280, a second pressure switch 282, a third pressure switch 284, a fourth pressure switch 286, a fifth pressure switch 288, and a sixth pressure switch 290 associated with the line 278 to monitor the pressure in the line 278. The functioning of the pressure switches 280, 282, 284, 286, 288, and 290 will be discussed in detail further herein. The condenser unit 202 is housed within a structure 292 such as a steel or aluminum cabinet. The form of the line between the lines 276 and 278 may be a coil. Various other components within the structure 292 which are part of the condenser unit 202 will be discussed further herein.

Figure 5:
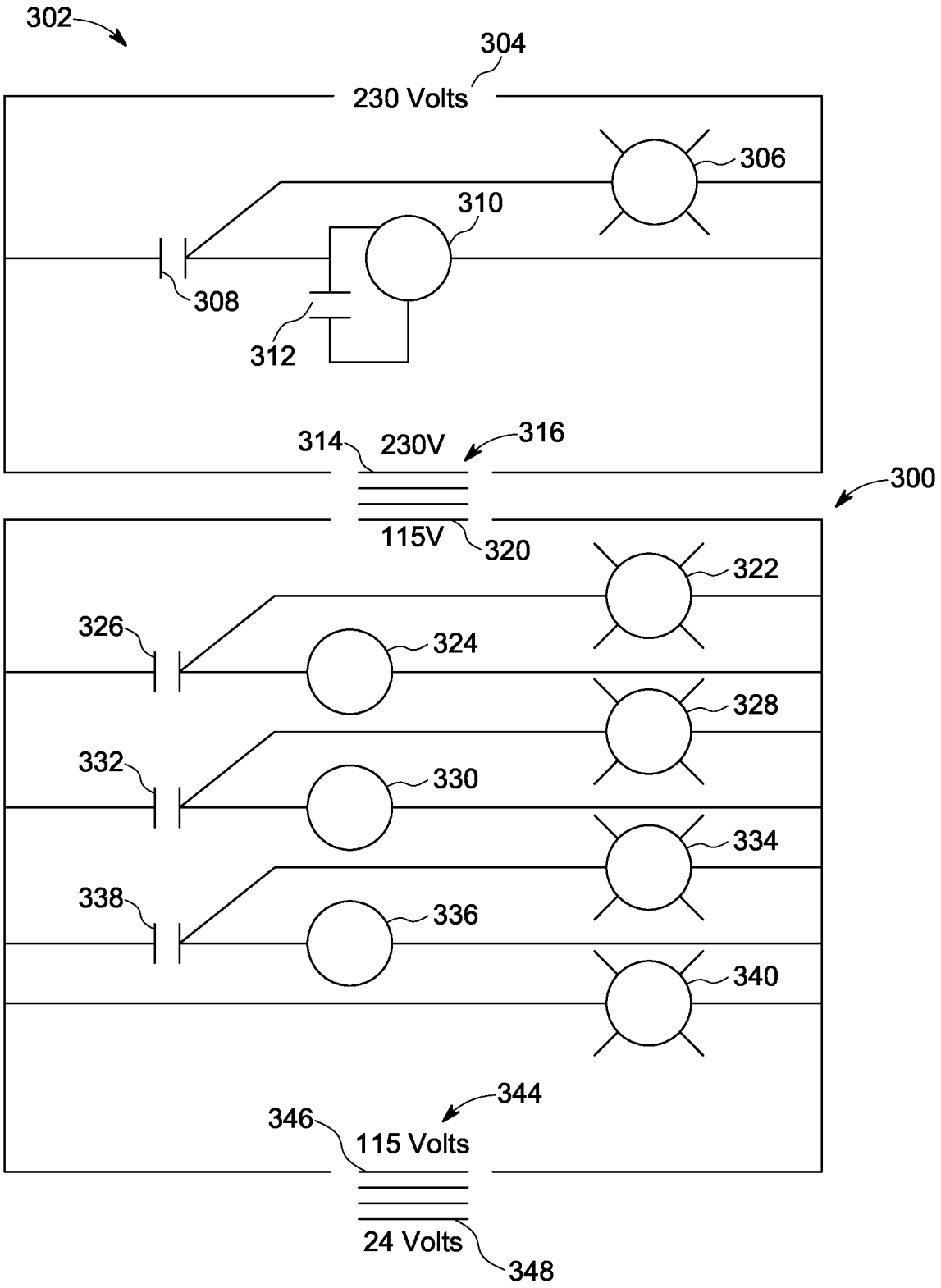
FIG. 5 is a first portion of a schematic diagram of a circuit used for operation of the air conditioning system of the present disclosure.

With reference now to FIG. 5, a first circuit portion 300 of a control circuit 302 for controlling operation of the air conditioning system 200 (FIG. 3) is illustrated. The control circuit 302 is connected to a 230 volt power source 304. The power source 304 is connected to a high voltage or 230 volt indicator power light 306, such as an LED (light emitting diode), a set of contacts 308, a compressor 310, a run capacitor 312, and a primary side 314 of a first step down transformer 316. The step down transformer 316 also has a secondary side 320 which provides 115 volt power to the control circuit 302. The secondary side 320 provides power to a first pump light 322, a first pump 324, such as the cooling tank pump 234 (FIG. 3), a first pump relay contact 326, a second pump indicator light 328, a second pump 330, such as the evaporator pump 210 (FIG. 3), a second pump relay contact 332, a third pump indicator light 334, a third pump 336, such as the condenser pump 218 (FIG. 3), a third pump relay contact 338, and a middle voltage or 115 volt indicator light 340. A second step down transformer 344 has a primary side 346 and a secondary side 348. The transformer 344 is used to step down the 115 volt power to 24 volt power or a low voltage.

Figure 6:
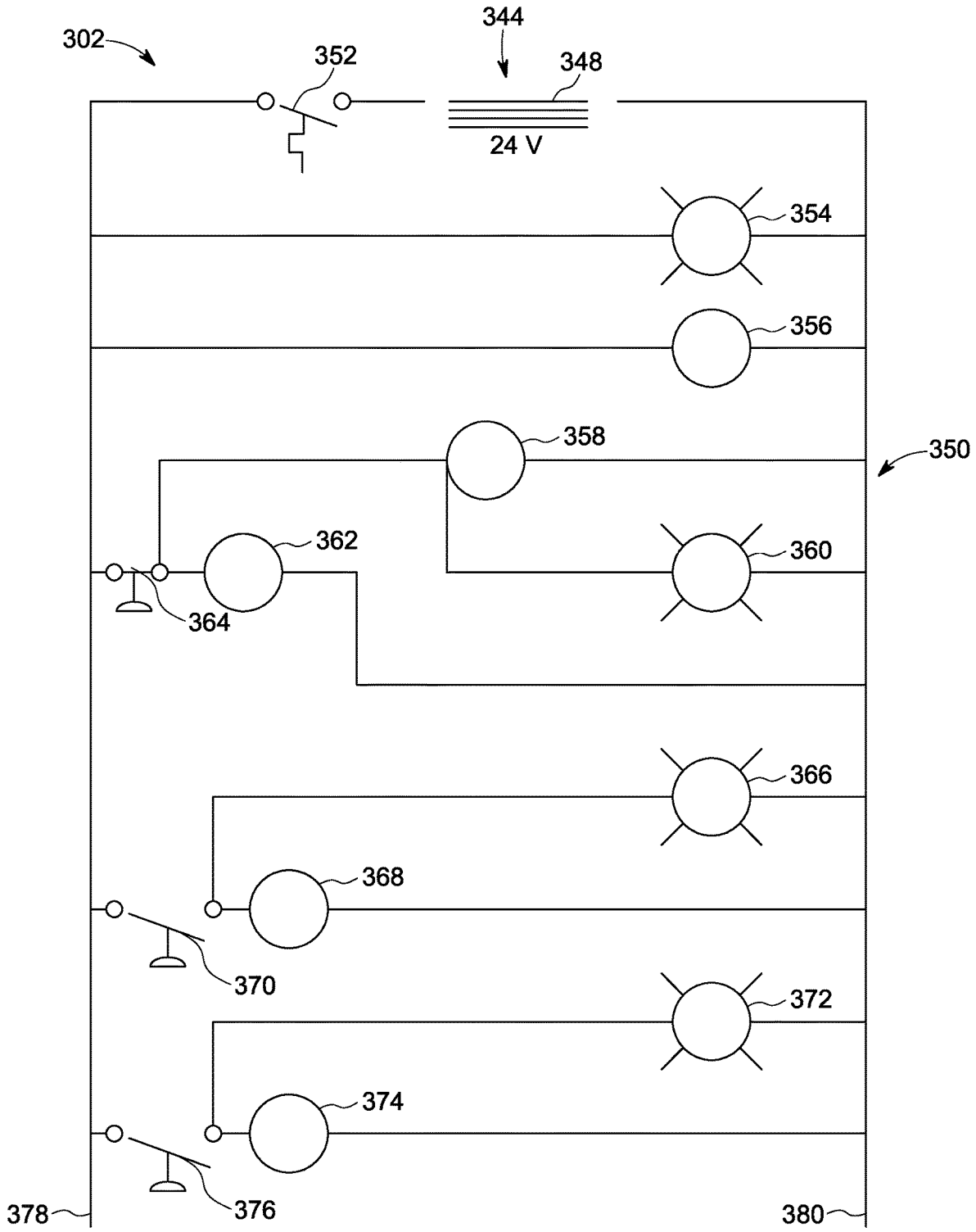
FIG. 6 is a second portion of a schematic diagram of a circuit used for operation of the air conditioning system of the present disclosure.

FIG. 6 illustrates a second circuit portion 350 of the control circuit 302. The secondary side 348 of the second step down transformer 344 is shown used to provide low voltage power of 24 volts to a room thermostat 352, a low voltage or 24 volt indicator light 354, a first compressor contactor 356 used to control operation of the compressor 310 (FIG. 4), a first pump relay 358, a first water circuit indicator light 360, a first water circuit solenoid 362, and a first normally closed pressure switch 364. The pressure switch 364 corresponds to the first pressure switch 280 (FIG. 4). The second circuit portion 350 also contains a second water circuit indicator light 366, a second water circuit solenoid 368, a second normally open pressure switch 370, a third water circuit indicator light 372, a third water circuit solenoid 374, and a third normally open pressure switch 376. A pair of leads 378 and 380 are also provided. The pressure switch 370 corresponds to the second pressure switch 282 (FIG. 4) and the pressure switch 376 corresponds to the third pressure switch 284 (FIG. 4).

Figure 7:
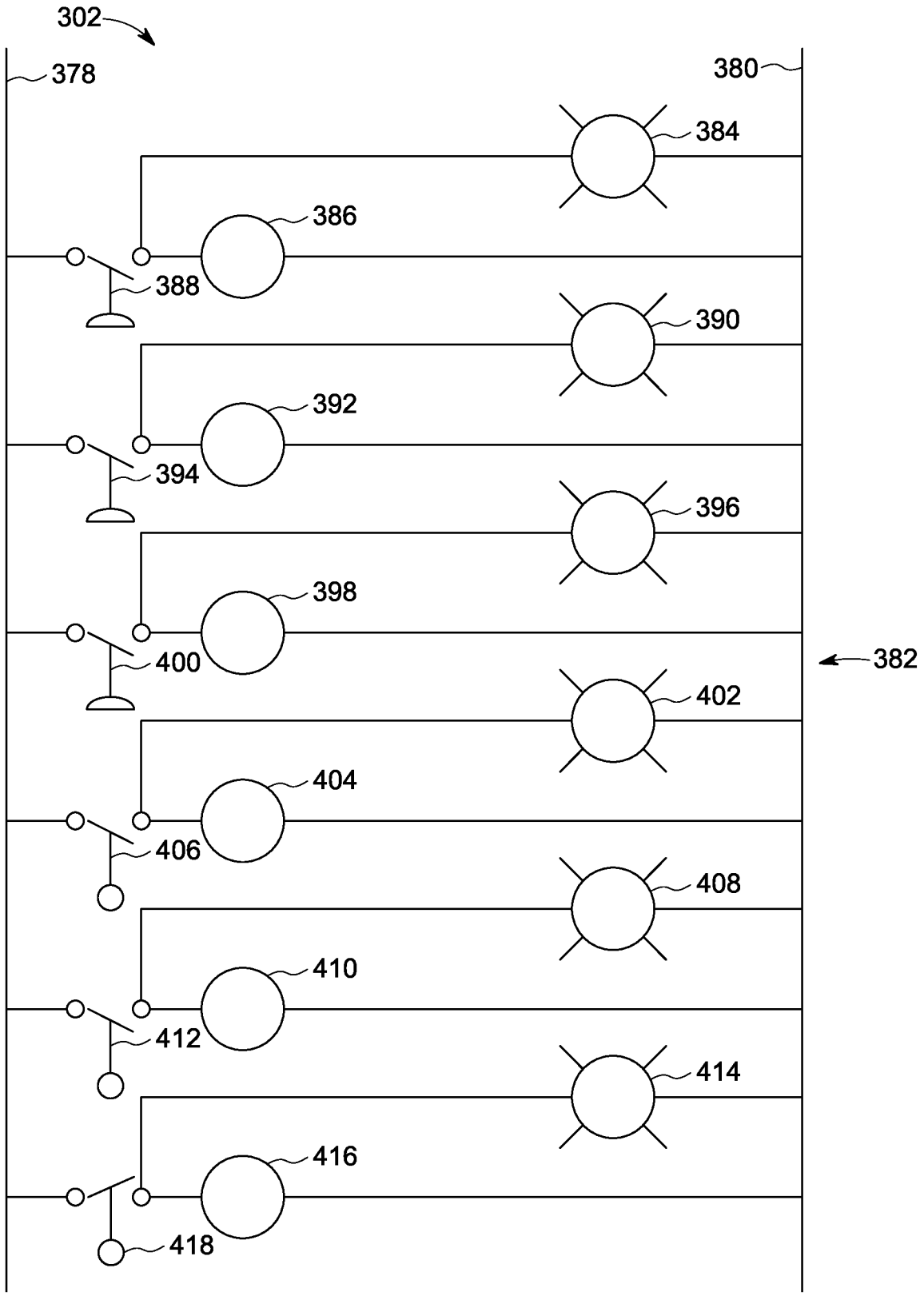
FIG. 7 is a third portion of a schematic diagram of a circuit used for operation of the air conditioning system of the present disclosure.

Referring now to FIG. 7, a third circuit portion 382 of the control circuit 302 is depicted. The third circuit portion 382 shows the leads 378 and 380 from the second portion 350. The leads 378 and 380 provide low voltage power to the third portion 382 from the secondary side 348 of the second step down transformer 344 (FIG. 5). The leads 378 and 380 are connected to a fourth water control circuit indicator light 384, a fourth water circuit solenoid 386, a fourth normally open pressure switch 388, a fifth water control circuit indicator light 390, a fifth water circuit solenoid 392, a fifth normally open pressure switch 394, a sixth water control circuit indicator light 396, a sixth water circuit solenoid 398, and a sixth normally open pressure switch 400. The pressure switches 388, 394, and 400 correspond to the fourth pressure switch 286, the fifth pressure switch 288, and the sixth pressure switch 290, respectively. The pressure switches 286, 288, and 290 are depicted in FIG. 4. The third circuit portion 382 also has a second pump relay indicator light 402, a second pump relay 404, a second pump normally open float switch 406, a third pump relay indicator light 408, a third pump relay 410, a third pump normally open float switch 412, a cooling tank solenoid indicator light 414, a cooling tank solenoid 416, and a cooling tank normally open float switch 418. As will be pointed further herein, the second pump relay 404 may be used to control the evaporator pump 210 and the third pump relay 410 may be used to control the condenser pump 218 with the pumps 210 and 218 being shown as part of the air conditioning system 200 in FIG. 3. Also, the cooling tank solenoid 416 is used to control the inlet valve 228 which is shown in FIG. 3.

Figure 8:
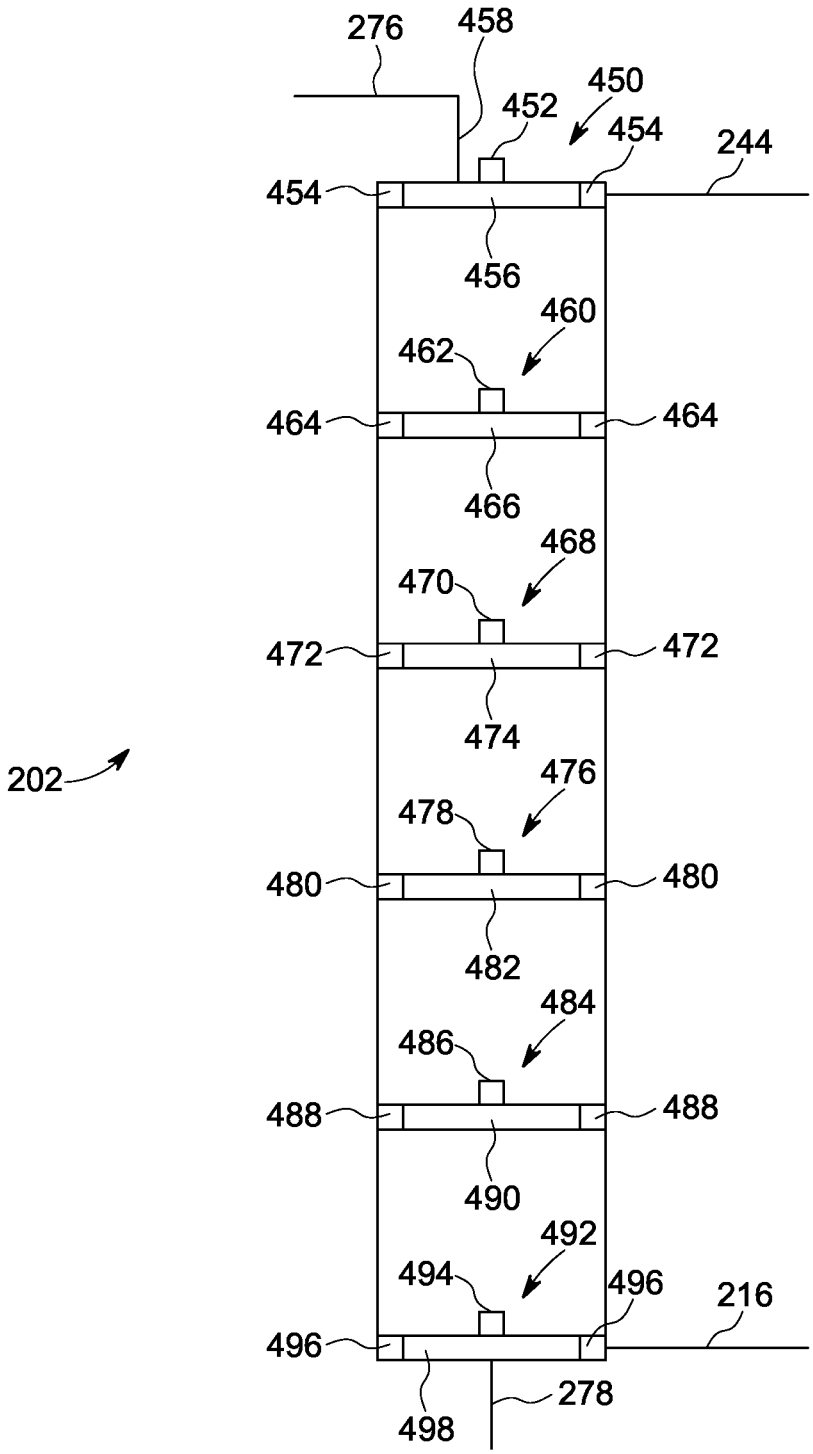
FIG. 8 is a front view of a condenser unit of the air conditioning system of the present disclosure.

FIG. 8 shows an interior view of the condenser unit 202 of FIG. 4. The condenser unit 202 has a first water circuit 450 connected to the pipe 244 which is adapted to receive water from the cooling tank 206 (FIG. 3). The first water circuit 450 has a first water circuit solenoid valve 452 and a number of spray nozzles 454 positioned along a first water circuit rail 456. One example of the number of spray nozzles 454 is eight. However, more or less spray nozzles 454 may be employed as the application requires. Each of the spray nozzles 454 is adapted for receiving water and spraying water on a condenser line 458 that runs through the condenser unit 202. The spray nozzles 454 operate once the solenoid valve 452 is actuated to spray water on the line 458. The condenser line 458 is between the lines 276 and 278. The condenser line 458 may take on any shape or form such as a coil. A second water circuit 460 has a second water circuit solenoid valve 462 and a number of spray nozzles 464 positioned along a second water circuit rail 466. Once the solenoid valve 462 is operated water will flow through the rail 466 to be sprayed by the nozzles 464. A third water circuit 468 has a third water circuit solenoid valve 470 and a number of spray nozzles 472 positioned along a third water circuit rail 474. Water will be sprayed out of the nozzles 472 once the valve 470 is operated. A fourth water circuit 476 is provided having a fourth water circuit solenoid valve 478 and a number of spray nozzles 480 positioned along a fourth water circuit rail 482. Operation of the solenoid valve 478 will allow water to flow in the rail 482 and out the nozzles 480. The condenser unit 202 has a fifth water circuit 484 having a fifth water circuit solenoid valve 486 and a number of spray nozzles 488 located along a fifth water circuit rail 490. When the solenoid valve 486 is actuated the spray nozzles 488 will be provided with water through the rail 490. A sixth water circuit 492 has a sixth water circuit solenoid 494 and a number of spray nozzles 496 positioned along a sixth water circuit rail 498. Each of the spray nozzles 496 is adapted for receiving water and spraying water on the condenser line 458 that runs through the condenser unit 202 once the solenoid valve 494 is actuated. Although six water circuits are shown and described it is also possible to have more or less water circuits in the condenser unit 202. Also, the pipe 216 is provided in the condenser unit 202 to collect sprayed water for sending the water back to the cooling tank 206 via the pump 218 and the condenser drain line 220, all of which are shown in FIG. 3. As can be appreciated, the solenoids 452, 462, 470, 478, 486, and 494 are connected to the control circuit 302 shown in FIGS. 5-7 to operate the water circuits 450, 460, 468, 476, 484, and 492 in a staged manner.

Referring now in particular to FIGS. 3 and 5-8, the operation of the air conditioning system 200 will now be discussed. The thermostat 352 is adjusted to a cool setting to request that the air conditioning system 200 operate. Once the thermostat 352 is turned to a cool setting power, such as 24 volt power, passes through the thermostat 352 to provide power to the low voltage or 24 volt indicator light 354 to illuminate the light 354. Power is also provided to the first compressor contactor 356, the first normally closed pressure switch 364, the first water circuit solenoid 362, and the first water circuit indicator light 360. Energizing the first compressor contactor 356 causes the set of contacts 308 to close to allow the 230 volt high voltage to pass through the contacts 308 to illuminate the high voltage or 230 volt indicator power light 306 and provide voltage to the capacitor 312 and the compressor 310 to start the compressor 310.

Power is also supplied to the relay 358 which energizes the relay 358 to close the contacts 326 to actuate the first pump 324 which may be the cooling tank pump 234 and to illuminate the pump light 322. This causes water to be pumped from the cooling tank 206 through the water softener unit 240 to the condenser unit 202. Operation of the solenoid 362 also allows water to flow through the first water circuit 450 of the condenser unit 202. Operation of the cooling tank pump 234 continues until either the thermostat 352 is turned off the cooling setting or the pressure switch 364 opens. Further, moving the thermostat 352 off the cooling setting will turn off the compressor 310. The second water circuit 460 will be operated if a condition exists that the pressure of the refrigerant rises to cause the second normally open pressure switch 370 to close. When the switch 370 closes the second water circuit solenoid 368 is operated. The second water circuit solenoid 368 may be connected to the second water circuit solenoid valve 462 to allow water to flow through the second water circuit rail 466 so that water may be sprayed out of the spray nozzles 464 to cool the condenser line 458. When the solenoid 368 is operated the second water circuit indicator light 366 is illuminated. The other water circuits 470, 476, 484, and 492 are operated in a similar manner depending upon operation of the pressure switches 376, 388, 394, and 400 sensing a range of refrigerant pressures. By way of example only and not in a limiting sense, the pressure switch 370 is capable of sensing pressures in the range of 50 to 100 psi, the pressure switch 376 is capable of sensing pressures in the range of 100 to 150 psi, the pressure switch 388 is capable of sensing pressures in the range of 150 to 200 psi, the pressure switch 394 is capable of sensing pressures in the range of 200 to 250 psi, the pressure switch 400 is capable of sensing pressures in the range of 250 to 300 psi. Further, the pressure switch 364 may be used to sense a pressure less than 50 psi.

When the float switch 406 rises, which is be positioned within the evaporator unit 204 and due to the amount of condensation in the evaporator unit 204, power will be supplied to the second pump relay 404 and to the second pump relay indicator light 402. The relay 404 will energize the second pump relay contacts 332 to operate the second pump 330 and illuminate the second pump indicator light 328. The second pump 330 may be the evaporator pump 210 which is used to pump condensation or water from the evaporator unit 202 to the cooling tank 206. When the float switch 412 rises, which may be positioned within the condenser unit 202 and due to the amount of water being sprayed within the condenser unit 202, power will be supplied to the third pump relay 410 and the third pump relay indicator light 408. The third pump relay 410 will energize the third pump relay contacts 338 to operate the third pump 336 and illuminate the third pump indicator light 334. The third pump 336 may be the condenser pump 218 which is used to pump water from the condenser unit 202 to the cooling tank 206. When the float switch 418 drops or closes the switch 418 will provide power to the cooling tank solenoid 416 and the cooling tank solenoid indicator light 414. The cooling tank solenoid 416 is used to control operation of the water inlet valve 228 connected to the main water supply 224. The float switch 418 may be located within the cooling tank 206. The float switch 418 is used to prevent the cooling tank 206 from going below a certain water level. Once the float switch 418 is operated, the solenoid 416 will open the valve 228 to allow water to flow into the cooling tank 206. Further, once enough water has been filled into the cooling tank 206 the float switch 418 will rise and remove power from the solenoid 416 which will cause the valve 228 to shut.

Figure 9:
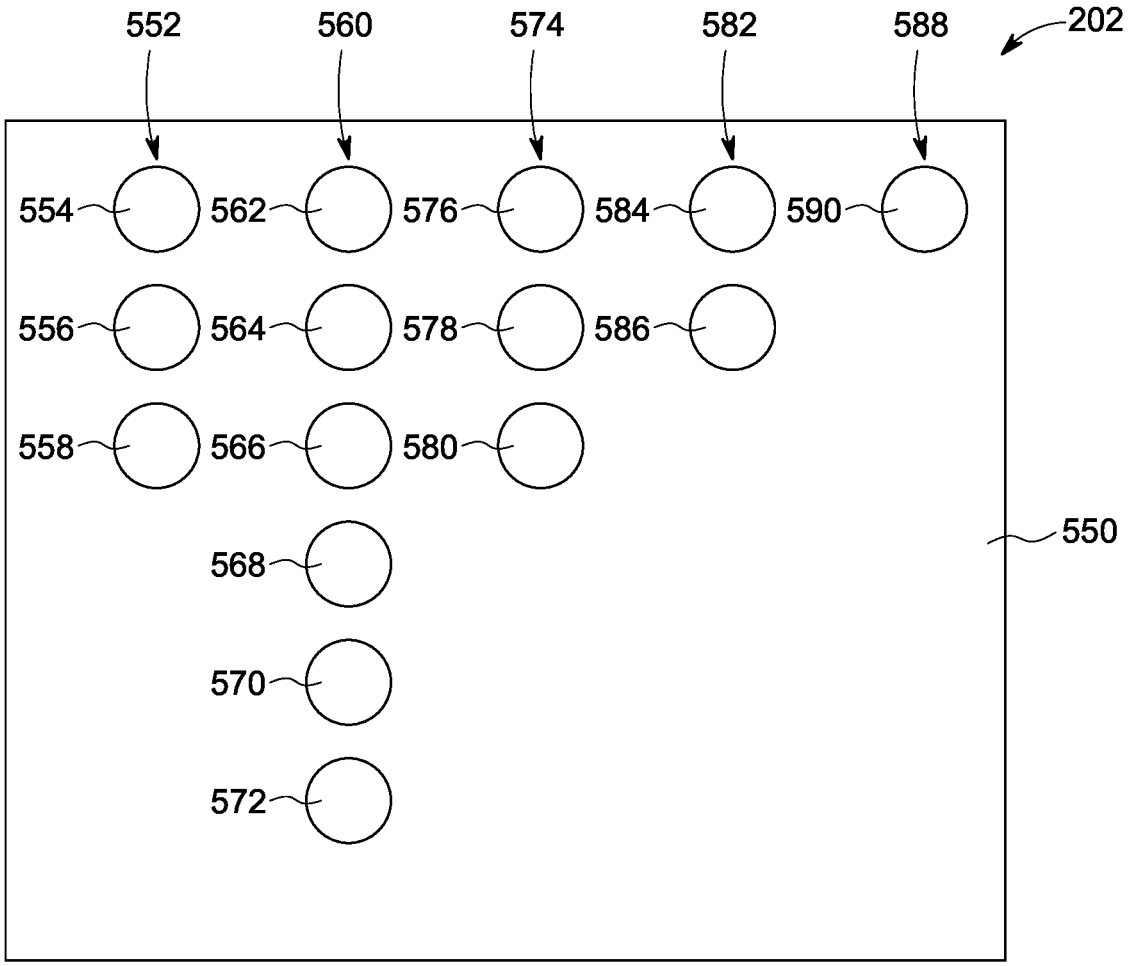
FIG. 9 is a front view of a panel of a condenser unit of the air conditioning system of the present disclosure.

FIG. 9 illustrates a front panel 550 for the condenser unit 202 (FIG. 3). The front panel 550 has a first column 552 of lights 554, 556, and 558 which are used to provide an indication of whether power is being supplied to the condenser unit 202. In particular, the light 554 represents whether 230 volt power is present, the light 556 represents whether 115 volt power is present, and the light 558 represents whether 24 volt power is present. The light 554 corresponds to the high voltage or 230 volt indicator power light 306, the light 556 corresponds to the middle voltage or 115 volt indicator light 340, and the light 558 corresponds to the low voltage or 24 volt indicator light 354. The lights 306, 340, and 354 were described in connection with the circuit 302 shown in FIGS. 5-7. A second column 560 is provided on the panel 552 having lights 562, 564, 566, 568, 570, and 572 for displaying whether the water circuits 450, 460, 468, 476, 484, and 492 are operating. The water circuits 450, 460, 468, 476, 484, and 492 were discussed in connection with the condenser unit 202 shown in FIG. 8. The light 562 is the same as the light 360, the light 564 is the same as the light 366, the light 566 is the same as the light 372, the light 568 is the same as the light 384, the light 570 is the same as the light 390, and the light 572 is the same as the light 396. A third column 574 has lights 576, 578, and 580 for displaying the status of the pumps 324, 330, and 336 (FIGS. 5-7). In particular, the light 576 corresponds to the light 322, the light 578 corresponds to the light 328, and the light 580 corresponds to the light 334. As has been previously indicated, the pump 324 may be the cooling tank pump 234 (FIG. 3), the pump 330 may be the evaporator pump 210 (FIG. 3), and the pump 336 may be the condenser pump 218 (FIG. 3). A fourth column 582 has lights 584 and 586 which are used to display the status of the pump relays 404 and 410. For example, the light 584 is the same as the light 402 and the light 586 is the same as the light 408. Also, a fifth column 588 is provided having a light 590 which is used to display the status of the level of water in the cooling tank 206 which equates to the inlet valve 228 (FIG. 3) being operated to fill the cooling tank 206 with water. The light 590 corresponds to the light 414. For troubleshooting purposes the indicator lights 306 and 322 will be illuminated when 230 volt power is present from the 230 volt power source 304. The indicator light 354 will be illuminated when 230 volt power is present and the thermostat 352 is set to the cooling setting.

From all that has been said, it will be clear that there has thus been shown and described herein an air conditioning system which fulfills the various objects and advantages sought therefor. It will be apparent to those skilled in the art, however, that many changes, modifications, variations, and other uses and applications of the subject air conditioning system are possible and contemplated. All changes, modifications, variations, and other uses and applications which do not depart from the spirit and scope of the disclosure are deemed to be covered by the disclosure, which is limited only by the claims which follow.

What is claimed is:

1. An air conditioning system comprising:

an evaporator having an outlet and capable of producing condensation;

an evaporator pump connected to the outlet of the evaporator;

a condenser having a first water circuit connected to an inlet, the first water circuit having a first water circuit solenoid valve and a first spray nozzle positioned along a first water circuit rail, a second water circuit having a second water circuit solenoid valve and a second spray nozzle positioned along a second water circuit rail, a third water circuit having a third water solenoid valve and a third spray nozzle positioned along a third water circuit rail, a fourth water circuit having a fourth water circuit solenoid valve and a fourth spray nozzle positioned along a fourth water circuit rail, a fifth water circuit having a fifth water circuit solenoid valve and a fifth spray nozzle positioned along a fifth water circuit rail, a sixth water circuit having a sixth water circuit solenoid valve and a sixth spray nozzle positioned along a sixth water circuit rail, and an outlet;

a condenser pump connected to the outlet of the condenser;

a reservoir pump; and a reservoir having a first inlet, a second inlet, and an outlet, the first inlet connected to the evaporator pump for receiving condensation from the evaporator, the reservoir pump connected to the outlet of the reservoir and to the inlet of the condenser for providing water to the condenser through the inlet of the condenser and the second inlet of the reservoir connected to the condenser pump for receiving water from the condenser.

2. The air conditioning system of claim 1 further comprising a panel having a first column of lights indicative of power being supplied to the condenser, a second column of lights indicative of operation of the water circuits, and a third column of lights indicative of operation of the pumps.

3. The air conditioning system of claim 1 further comprising a panel having a first column of lights indicative of power being supplied to the condenser.

4. The air conditioning system of claim 1 wherein the first spray nozzle is capable of spraying water from the reservoir once the first water circuit solenoid is operated.

5. The air conditioning system of claim 4 wherein the reservoir is capable of receiving sprayed water from the condenser through the outlet of the condenser.

* * * * *